US007950476B2

(12) United States Patent
McDonough et al.

(10) Patent No.: US 7,950,476 B2
(45) **Date of Patent: *May 31, 2011**

(54) DRILL BIT AND CUTTER ELEMENT HAVING CHISEL CREST WITH PROTRUDING PILOT PORTION

(75) Inventors: Scott D. McDonough, Houston, TX (US); Amardeep Singh, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/618,997

(22) Filed: Nov. 16, 2009

(65) Prior Publication Data

US 2010/0059286 A1 Mar. 11, 2010

Related U.S. Application Data

(63) Continuation of application No. 11/619,395, filed on Jan. 3, 2007, now Pat. No. 7,631,709.

(51) Int. Cl.
*E21B 10/16* (2006.01)

(52) U.S. Cl. ..... 175/430; 175/374; 175/378; 175/398; 175/420; 175/431

(58) Field of Classification Search ..... 175/374, 175/430, 378, 398, 431, 419, 420
See application file for complete search history.

(56) References Cited

U.S. PATENT DOCUMENTS 2,578,593 A 10/1946 Phipps
2,592,440 A * 4/1952 Liddicoat ..... 175/389
3,388,757 A 6/1968 Fittinger
3,442,342 A 5/1969 McElya et al.
3,946,820 A 3/1976 Knapp
4,056,153 A 11/1977 Miglierini
4,058,177 A 11/1977 Langford, Jr. et al.
4,086,973 A 5/1978 Keller et al.
4,108,260 A 8/1978 Bozarth
4,254,840 A 3/1981 Shay, Jr.
4,334,586 A 6/1982 Schumacher
4,352,400 A 10/1982 Grappendorf et al.
4,511,006 A 4/1985 Grainger
4,586,574 A 5/1986 Grappendorf
(Continued)

FOREIGN PATENT DOCUMENTS

EP 0 391 683 B1 10/1990
(Continued)

OTHER PUBLICATIONS

Office Action Dated Apr. 22, 2009 for U.S. Appl. No. 11/157,656 (8 p.).

(Continued)

*Primary Examiner* — Giovanna C Wright
(74) *Attorney, Agent, or Firm* — Christie, Parker & Hale, LLP

(57) ABSTRACT

A rolling cone drill bit includes a cutter element having a cutting portion with a chisel crest and a pilot portion extending beyond the chisel crest. The pilot portion includes a cutting surface that may be generally conical, or form a second chisel crest. The cutting tip of the pilot portion is supported by buttress portions which emerge from and extend beyond the flanks of the chisel crest to provide additional strength and support for the material of the pilot portion that extends beyond the height of the chisel crest.

28 Claims, 12 Drawing Sheets

U.S. PATENT DOCUMENTS

| | | | |
|---|---|---|---|
| 4,716,977 | A | 1/1988 | Huffstutler |
| 4,722,405 | A | 2/1988 | Langford, Jr. |
| 4,811,801 | A | 3/1989 | Salesky et al. |
| 4,832,139 | A | 5/1989 | Minikus et al. |
| 4,854,405 | A | 8/1989 | Stroud |
| 4,951,762 | A | 8/1990 | Lundell |
| D324,527 | S | 3/1992 | Slutz |
| 5,131,478 | A | 7/1992 | Brett et al. |
| 5,172,777 | A | 12/1992 | Siracki et al. |
| 5,172,779 | A | 12/1992 | Siracki et al. |
| 5,197,555 | A | 3/1993 | Estes |
| 5,201,376 | A | 4/1993 | Williams |
| 5,303,787 | A | 4/1994 | Brady |
| 5,322,138 | A | 6/1994 | Siracki |
| 5,323,865 | A | 6/1994 | Isbell et al. |
| 5,341,890 | A | 8/1994 | Cawthorne et al. |
| 5,351,768 | A | 10/1994 | Scott et al. |
| 5,372,210 | A | 12/1994 | Harrell |
| 5,379,854 | A | 1/1995 | Dennis |
| 5,407,022 | A | 4/1995 | Scott et al. |
| 5,415,244 | A | 5/1995 | Portwood |
| 5,421,423 | A | 6/1995 | Huffstutler |
| 5,421,424 | A | 6/1995 | Portwood et al. |
| 5,429,199 | A | 7/1995 | Sheirer et al. |
| 5,429,200 | A | 7/1995 | Blackman et al. |
| 5,452,771 | A | 9/1995 | Blackman et al. |
| 5,479,997 | A | 1/1996 | Scott et al. |
| 5,518,077 | A | 5/1996 | Blackman et al. |
| 5,533,582 | A | 7/1996 | Tibbitts |
| 5,535,839 | A | 7/1996 | Brady |
| 5,542,485 | A | 8/1996 | Pessier et al. |
| 5,560,440 | A | 10/1996 | Tibbitts |
| 5,592,995 | A | 1/1997 | Scott et al. |
| 5,636,700 | A | 6/1997 | Shamburger, Jr. |
| 5,644,956 | A | 7/1997 | Blackman et al. |
| 5,695,019 | A | 12/1997 | Shamburger, Jr. |
| 5,697,462 | A | 12/1997 | Grimes et al. |
| 5,709,278 | A | 1/1998 | Crawford |
| 5,743,346 | A | 4/1998 | Flood et al. |
| 5,746,280 | A | 5/1998 | Scott et al. |
| 5,752,573 | A | 5/1998 | Scott et al. |
| 5,755,301 | A | 5/1998 | Love et al. |
| 5,813,485 | A | 9/1998 | Portwood |
| 5,819,861 | A | 10/1998 | Scott et al. |
| 5,833,020 | A | 11/1998 | Portwood et al. |
| 5,839,526 | A | 11/1998 | Cisneros et al. |
| 5,871,060 | A | 2/1999 | Jensen et al. |
| 5,874,060 | A | 2/1999 | Armour et al. |
| 5,881,828 | A | 3/1999 | Fischer et al. |
| 5,887,655 | A | 3/1999 | Haugen et al. |
| 5,887,668 | A | 3/1999 | Haugen et al. |
| 5,890,550 | A | 4/1999 | Swadi et al. |
| 5,915,486 | A | 6/1999 | Portwood et al. |
| 5,950,745 | A | 9/1999 | Ingmarsson |
| 5,967,245 | A | 10/1999 | Garcia et al. |
| 6,029,759 | A | 2/2000 | Sue et al. |
| 6,053,263 | A | 4/2000 | Meiners |
| 6,059,054 | A | 5/2000 | Portwood et al. |
| 6,105,693 | A | 8/2000 | Ingmarsson |
| 6,105,694 | A | 8/2000 | Scott |
| D430,578 | S | 9/2000 | Brady |
| 6,161,634 | A | 12/2000 | Minikus et al. |
| 6,176,332 | B1 | 1/2001 | Massa et al. |
| 6,176,333 | B1 | 1/2001 | Doster |
| 6,196,340 | B1 | 3/2001 | Jensen et al. |
| 6,199,645 | B1 | 3/2001 | Anderson et al. |
| 6,202,752 | B1 | 3/2001 | Kuck et al. |
| 6,241,034 | B1 | 6/2001 | Steinke et al. |
| 6,241,035 | B1 | 6/2001 | Portwood |
| 6,290,008 | B1 | 9/2001 | Portwood et al. |
| 6,367,568 | B2 | 4/2002 | Steinke et al. |
| 6,510,910 | B2 | 1/2003 | Eyre et al. |
| 6,530,441 | B1 | 3/2003 | Singh et al. |
| 6,561,293 | B2 | 5/2003 | Minikus et al. |
| 6,595,305 | B1 | 7/2003 | Dunn et al. |
| 6,601,662 | B2 | 8/2003 | Matthias et al. |
| 6,745,645 | B2 | 6/2004 | Griffo |
| 6,782,959 | B2 | 8/2004 | Minikus et al. |
| 6,883,624 | B2 | 4/2005 | McDonough |
| 6,929,079 | B2 | 8/2005 | McDonough et al. |
| 7,013,999 | B2 | 3/2006 | Tufts |
| 7,040,424 | B2 | 5/2006 | Yong et al. |
| 7,152,703 | B2 | 12/2006 | Meiners et al. |
| 2004/0173384 | A1* | 9/2004 | Yong et al. ..... 175/374 |
| 2005/0247492 | A1 | 11/2005 | Shen et al. |

FOREIGN PATENT DOCUMENTS

| | | | |
|---|---|---|---|
| EP | 0 446 765 | B1 | 9/1991 |
| EP | 0 527 506 | A2 | 2/1993 |
| EP | 0 902 159 | A2 | 3/1999 |
| GB | 2 361 497 | A | 10/2001 |
| GB | 2 369 841 | A | 6/2002 |
| GB | 2 393 982 | A | 4/2004 |
| GB | 2 398 330 | A | 8/2004 |
| RU | 2 105 124 | C1 | 2/1998 |
| RU | 2 153 569 | C2 | 7/2000 |
| WO | WO 01/61142 | A1 | 8/2001 |

OTHER PUBLICATIONS

Response to Office Action Dated Apr. 22, 2009 for U.S. Appl. No. 11/157/656 (16 p.).
Response to Final Office Action Dated May 22, 2009 for U.S. Appl. No. 11/619,416; (22 p.).
Advisory Action Dated Aug. 7, 2009 for U.S. Appl. No. 11/619,416; (3 p.).
Supplemental Response to Final Office Action Dated May 22, 2009 for U.S. Appl. No. 11/619,416; (18 p.).
Notice of Allowance and Fee(s) Due dated Nov. 16, 2009 for U.S. Appl. No. 11/619,416; (9 p.).
Notice of Allowance and Fee(s) Due dated Mar. 1, 2010 for U.S. Appl. No. 11/157,656; (9 p.).
Office Action dated Nov. 13, 2008 for U.S. Appl. No. 11/619,395 (14 p.).
Response to Office Action dated Nov. 13, 2008 for U.S. Appl. No. 11/619,395 (24 p.).
Notice of Allowance and Fee(s) Due for U.S. Appl. No. 11/619,395 (6 p.), dated Jul. 31, 2009 .
Office Action dated Aug. 25, 2009 for U.S. Appl. No. 11/858,359 (24 p.).
Response to Office Action Dated Aug. 25, 2009 for U.S. Appl. No. 11/858,359 (24 p.).
Response to Restriction Requirement and Response to Office Action dated Jul. 9, 2009 for U.S. Appl. No. 11/947,226 (15 p.).
Final Office Action Dated Feb. 18, 2010 for U.S. Appl. No. 11/947,226 (23 p.).
Request for Continued Examination and Response to Final Office Action Dated Feb. 18, 2010 for U.S. Appl. No. 11/947,226; (20 p.).
Search Report for Appl. No. GB 0403620.8 dated May 5, 2004 (2 p.).
Search Report for Appl. No. GB 0402108.5 dated Apr. 22, 2004; (1 p.).
Search Report for Appl. No. GB 0404709.8 dated Sep. 23, 2004; (1 p.).
Search Report for Appl. No. GB 0416617.9 dated Sep. 9, 2004; (1 p.).
Office Action Dated May 17, 2007 for U.S. Appl. No. 11/157,656 (18 p.).
Response to Office Action Dated May 17, 2007 for U.S. Appl. No. 11/157,656 (23 p.).
Office Action Dated Aug. 31, 2007 for U.S. Appl. No. 11/157,656 (12 p.).
Response to Office Action Dated Aug. 31, 2007 for U.S. Appl. No. 11/157,656 (19 p.).
Final Office Action Dated Feb. 19, 2008 for U.S. Appl. No. 11/157,656 (18 p.).
Response to Final Office Action Dated Feb. 19, 2008 for U.S. Appl. No. 11/157,656 (15 p.).
Advisory Action Dated May 5, 2008 for U.S. Appl. No. 11/157,656 (3 p.).
Request for Continued Examination (RCE) and Preliminary Amendment; for U.S. Appl. No. 11/157,656 (25 p.), dated Aug. 19, 2008.
Office Action Dated Oct. 17, 2008 for U.S. Appl. No. 11/157,656 (4 p.).

Response to Office Action Dated Oct. 17, 2008 for U.S. Appl. No. 11/157,656 (5 p.).
Notice of Allowance and Fee(s) Due Dated Dec. 8, 2008 for U.S. Appl. No. 11/157,656 (4 p.).
Office Action Dated Jul. 9, 2009 for U.S. Appl. No. 11/947,226 (13 p.).
Office Action Dated Sep. 3, 2004 for U.S. Appl. No. 10/371,388 (5 p.).
Response to Office Action Dated Sep. 3, 2004 for U.S. Appl. No. 10/371,388 (15 p.).
Notice of Allowance for U.S. Appl. No. 10/371,388 dated Apr. 13, 2005 (6 p).
Office Action Dated Sep. 23, 2004 for U.S. Appl. No. 10/379,015 (12 p.).
Response to Office Action Dated Sep. 23, 2004 for U.S. Appl. No. 10/379,015 (23 p).
Office Action Dated Feb. 22, 2005 for U.S. Appl. No. 10/379,015 (7 p.).
Response to Office Action Dated Feb. 22, 2005 for U.S. Appl. No. 10/379,015 (19 p).
Office Action dated Aug. 29, 2006 for U.S. Appl. No. 10/379,015 (7 p.).
Response to Office Action dated Aug. 29, 2006 for U.S. Appl. No. 10/379,015 (19 p.).
Notice of Allowance dated Jan. 31, 2006 for U.S. Appl. No. 10/379,016 (6 p.).
Office Action Dated Apr. 28, 2005 for U.S. Appl. No. 10/628,191 (12 p.).
Response to Office Action Dated Apr. 28, 2005 for U.S. Appl. No. 10/628,191 (26 p.).
Notice of Allowance Dated Oct. 12, 2005 for U.S. Appl. No. 10/628,191 (4 p.).
Office Action Dated Apr. 13, 2004 for U.S. Appl. No. 10/355,493 (10 p.).
Response to Office Action Dated Apr. 13, 2004 for U.S. Appl. No. 10/355,493 (32 p.).
Final Office Action Dated Aug. 23, 2004 for U.S. Appl. No. 10/355,493 (7 p.).
Response to Final Office Action Dated Aug. 24, 2004 for U.S. Appl. No. 10/355,493 (19 p).
Notice of Allowance Dated Dec. 20, 2004 for U.S. Appl. No. 10/355,493 (6 p).
Office Action dated Nov. 24, 2008 for U.S. Appl. No. 11/619,416 (11 p.).
Response to Office Action Dated Nov. 24, 2008 for U.S. Appl. No. 11/619,416 (17 p.).
Final Office Action dated May 22, 2009 for U.S. Appl. No. 11/619,416 (20 p.).

* cited by examiner

DRILL BIT AND CUTTER ELEMENT HAVING CHISEL CREST WITH PROTRUDING PILOT PORTION

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE TECHNOLOGY

1. Field of the Invention

The invention relates generally to earth-boring bits used to drill a borehole for the ultimate recovery of oil, gas or minerals. More particularly, the invention relates to rolling cone rock bits and to an improved cutting structure and cutter element for such bits.

2. Background Information

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Because drilling costs are typically thousands of dollars per hour, it is thus always desirable to employ drill bits which will drill faster and longer and which are usable over a wider range of formation hardness.

The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP.

One common earth-boring bit includes one or more rotatable cone cutters that perform their cutting function due to the rolling movement of the cone cutters acting against the formation material. The cone cutters roll and slide upon the bottom of the borehole as the bit is rotated, the cone cutters thereby engaging and disintegrating the formation material in its path. The rotatable cone cutters may be described as generally conical in shape and are therefore sometimes referred to as rolling cones, cone cutters, or the like. The borehole is formed as the gouging and scraping or crushing and chipping action of the rotary cones removes chips of formation material which are carried upward and out of the borehole by drilling fluid which is pumped downwardly through the drill pipe and out of the bit.

The earth disintegrating action of the rolling cone cutters is enhanced by providing the cone cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are commonly known as "steel tooth bits." In each instance, the cutter elements on the rotating cone cutters break up the formation to form new boreholes by a combination of gouging and scraping or chipping and crushing. The shape and positioning of the cutter elements (both steel teeth and tungsten carbide inserts) upon the cone cutters greatly impact bit durability and ROP and thus, are important to the success of a particular bit design.

The inserts in TCI bits are typically positioned in circumferential rows on the rolling cone cutters. Most such bits include a row of inserts in the heel surface of the rolling cone cutters. The heel surface is a generally frustoconical surface configured and positioned so as to align generally with and ream the sidewall of the borehole as the bit rotates. Conventional bits typically include a circumferential gage row of cutter elements mounted adjacent to the heel surface but oriented and sized in such a manner so as to cut the corner of the borehole. Conventional bits also include a number of inner rows of cutter elements that are located in circumferential rows disposed radially inward or in board from the gage row. These cutter elements are sized and configured for cutting the bottom of the borehole, and are typically described as inner row cutter elements.

Inserts in TCI bits have been provided with various geometries. One insert typically employed in an inner row may generally be described as a "conical" insert, one having a cutting surface that tapers from a cylindrical base to a generally rounded or spherical apex. Such an insert is shown, for example, in FIGS. 4A-C in U.S. Pat. No. 6,241,034. Conical inserts have particular utility in relatively hard formations as the weight applied to the formation through the insert is concentrated, at least initially, on the relatively small surface area of the apex. However, because of the conical insert's relatively narrow profile, in softer formations, it is not able to remove formation material as quickly as would an insert having a wider cutting profile.

Another common shape for an insert for use in inner rows is what generally may be described as "chisel" shaped. Rather than having the spherical apex of the conical insert, a chisel insert generally includes two generally flattened sides or flanks that converge and terminate in an elongated crest at the terminal end of the insert. The chisel element may have rather sharp transitions where the flanks intersect the more rounded portions of the cutting surface, as shown, for example, in FIGS. 1-8 in U.S. Pat. No. 5,172,779. In other designs, the surfaces of the chisel insert may be contoured or blended so as to eliminate sharp transitions and to present a more rounded cutting surface, such as shown in FIGS. 3A-D in U.S. Pat. No. 6,241,034 and FIGS. 9-12 in U.S. Pat. No. 5,172,779. In general, it has been understood that, as compared to a conical inset, the chisel-shaped insert provides a more aggressive cutting structure that removes formation material at a faster rate for as long as the cutting structure remains intact. For this reason, in soft formations, chisel-shaped inserts are frequently preferred for bottom hole cutting.

Despite this advantage of chisel-shaped inserts, however, such cutter elements have shortcomings when it comes to drilling in harder formations, where the relatively sharp cutting edges and chisel crest of the chisel insert endure high stresses that may lead to chipping and ultimately breakage of the insert. Likewise, in hard and abrasive formations, the chisel crest may wear dramatically. Both wear and breakage may cause a bit's ROP to drop dramatically, as for example, from 80 feet per hour to less than 10 feet per hour. Once the cutting structure is damaged and the rate of penetration reduced to an unacceptable rate, the drill string must be removed in order to replace the drill bit. As mentioned, this "trip" of the drill string is extremely time consuming and expensive to the driller.

As will be understood then, there remains a need in the art for a cutter element and cutting structure that will provide a high rate of penetration and be durable enough to withstand hard and abrasive formations.

SUMMARY OF THE PREFERRED EMBODIMENTS

The embodiments described herein include a drill bit and a cutter element for use in a rolling cone drill bit. The cutter element includes a cutting portion having a chisel crest with flanking surfaces tapering toward one another and intersecting in an elongated and peaked ridge, and having a pilot portion intersecting the chisel crest and extending beyond the height of the chisel crest. The pilot portion may include a generally spherical or rounded apex, or may include a second chisel crest. The pilot portion divides the chisel crest into separate crest segments which may have the same or different crest lengths. Likewise, the crest segments may extend to the same or to differing extension heights. Either the pilot portion, the chisel crest, or both portions may be offset from the insert's axis. Likewise, a chisel crest may be sharper at one end than the other end, or may extend further than the other end from the cutter element's base. The pilot portion, with its greater extension height and smaller cross-sectional area, initiates formation fracture, causing cracks to propagate into the uncut formation. The crest segments, at least in certain embodiments, will extend laterally to a greater extent than the pilot portion, and subsequently remove formation that has been pre-fractured by the pilot portion. Further enhancements may be provided by positioning the cutter element in the rolling cone cutter such that the chisel crests are oriented in a particularly desirable way and via material enhancements. By varying the geometry of the pilot portion and chisel crest, their orientation, extension heights, and other characteristics, the cutter elements and drill bit may be better able to resist wear and increase ROP.

Thus, the embodiments described herein comprise a combination of features and characteristics which are directed to overcoming some of the shortcomings of prior bits and cutter element designs. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
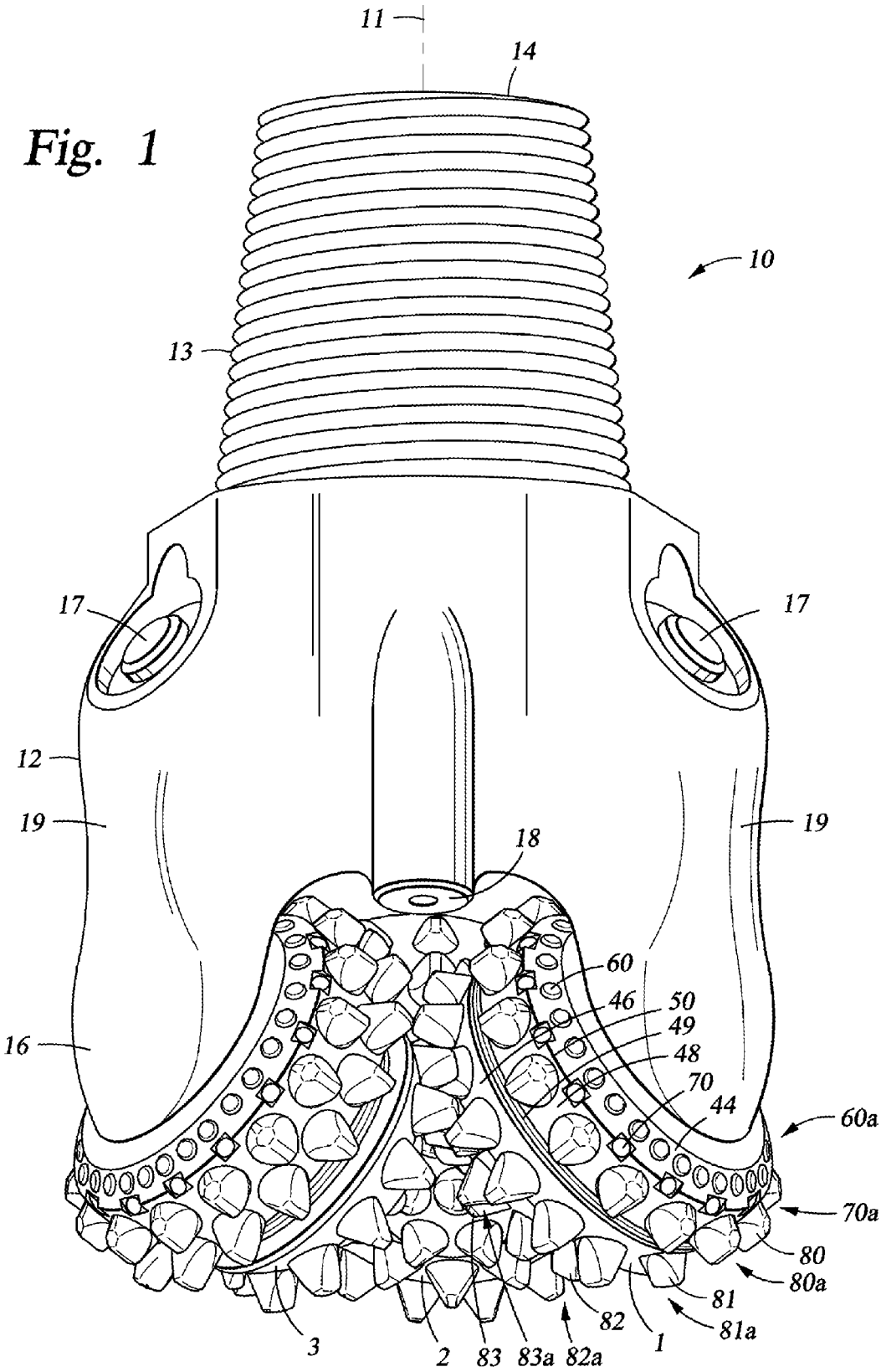
FIG. 1 is a perspective view of an earth-boring bit.

Referring first to FIG. 1, an earth-boring bit 10 is shown to include a central axis 11 and a bit body 12 having a threaded pin section 13 at its upper end that is adapted for securing the bit to a drill string (not shown). The uppermost end will be referred to herein as pin end 14. Bit 10 has a predetermined gage diameter as defined by the outermost reaches of three rolling cone cutters 1, 2, 3 which are rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters. Bit legs 19 include a shirttail portion 16 that serves to protect the cone bearings and cone seals from damage as might be caused by cuttings and debris entering between leg 19 and its respective cone cutter.

Figure 2:
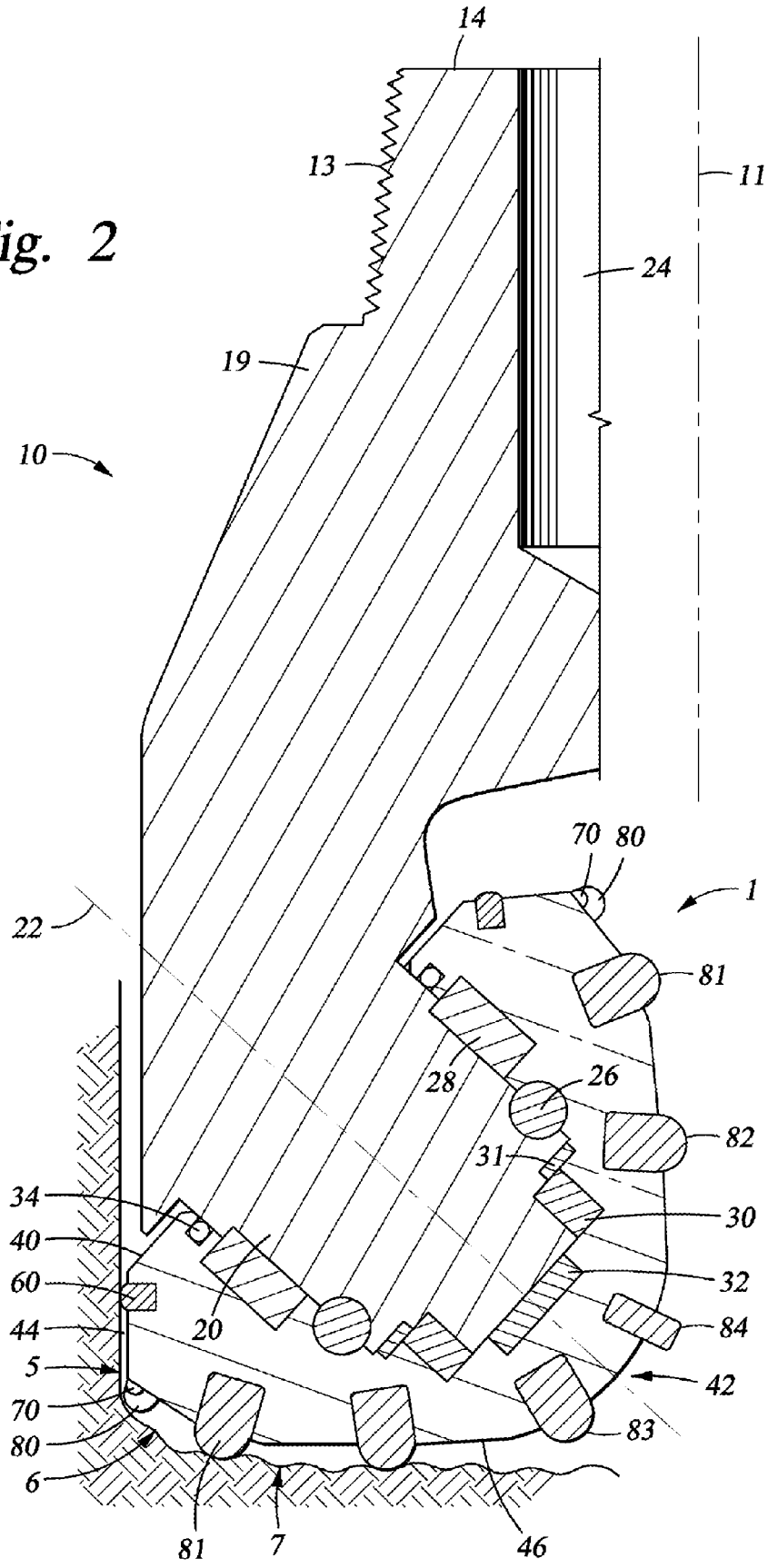
FIG. 2 is a partial section view taken through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial and axial thrust are absorbed by roller bearings 28, 30, thrust washer 31 and thrust plug 32. The bearing structure shown is generally referred to as a roller bearing; however, the invention is not limited to use in bits having such structure, but may equally be applied in a bit where cone cutters 1-3 are mounted on pin 20 with a journal bearing or friction bearing disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Referring still to FIGS. 1 and 2, each cone cutter 1-3 includes a generally planar backface 40 and nose portion 42. Adjacent to backface 40, cutters 1-3 further include a generally frustoconical surface 44 that is adapted to retain cutter elements that scrape or ream the sidewalls of the borehole as the cone cutters rotate about the borehole bottom. Frustoconical surface 44 will be referred to herein as the "heel" surface of cone cutters 1-3. It is to be understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Frustoconical heel surface 44 and conical surface 46 converge in a circumferential edge or shoulder 50, best shown in FIG. 1. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions or bands 48 generally referred to as "lands" which are employed to support and secure the cutter elements as described in more detail below. Grooves 49 are formed in cone surface 46 between adjacent lands 48.

In the bit shown in FIGS. 1 and 2, each cone cutter 1-3 includes a plurality of wear resistant cutter elements in the form of inserts which are disposed about the cone and arranged in circumferential rows in the embodiment shown. More specifically, rolling cone cutter 1 includes a plurality of heel inserts 60 that are secured in a circumferential row 60*a* in the frustoconical heel surface 44. Cone cutter 1 further includes a first circumferential row 70*a* of gage inserts 70 secured to cone cutter 1 in locations along or near the circumferential shoulder 50. Additionally, the cone cutter includes a second circumferential row 80*a* of gage inserts 80. The cutting surfaces of inserts 70, 80 have differing geometries, but each extends to full gage diameter. Row 70*a* of the gage inserts is sometimes referred to as the binary row and inserts 70 sometimes referred to as binary row inserts. The cone cutter 1 further includes inner row inserts 81, 82, 83 secured to cone surface 46 and arranged in concentric, spaced-apart inner rows 81*a*, 82*a*, 83*a*, respectively. Heel inserts 60 generally function to scrape or ream the borehole sidewall 5 to maintain the borehole at full gage and prevent erosion and abrasion of the heel surface 44. Gage inserts 80 function primarily to cut the corner of the borehole. Binary row inserts 70 function primarily to scrape the borehole wall and serve to prevent gage inserts 80 from wearing as rapidly as might otherwise occur Inner row cutter elements 81, 82, 83 of inner rows 81*a*, 82*a*, 83*a* are employed to gouge and remove formation material from the remainder of the borehole bottom 7. Insert rows 81*a*, 82*a*, 83*a* are arranged and spaced on rolling cone cutter 1 so as not to interfere with rows of inner row cutter elements on the other cone cutters 2, 3. Cone 1 is further provided with relatively small "ridge cutter" cutter elements 84 in nose region 42 which tend to prevent formation build-up between the cutting paths followed by adjacent rows of the more aggressive, primary inner row cutter elements from different cone cutters. Cone cutters 2 and 3 have heel, gage and inner row cutter elements and ridge cutters that are similarly, although not identically, arranged as compared to cone 1. The arrangement of cutter elements differs as between the three cones in order to maximize borehole bottom coverage, and also to provide clearance for the cutter elements on the adjacent cone cutters.

In the embodiment shown, inserts 60, 70, 80-83 each includes a generally cylindrical base portion, a central axis, and a cutting portion that extends from the base portion, and further includes a cutting surface for cutting the formation material. The base portion is secured by interference fit into a mating socket drilled into the surface of the cone cutter.

A cutter element 100 is shown in FIGS. 3-6 and is believed to have particular utility when employed as an inner row cutter element, such as in inner rows 81*a* or 82*a* shown in FIGS. 1 and 2 above. However, cutter element 100 may also be employed in other rows and other regions on the cone cutter, such as in heel row 60*a* and gage rows 70*a*, 70*b* shown in FIGS. 1 and 2.

Figure 4:
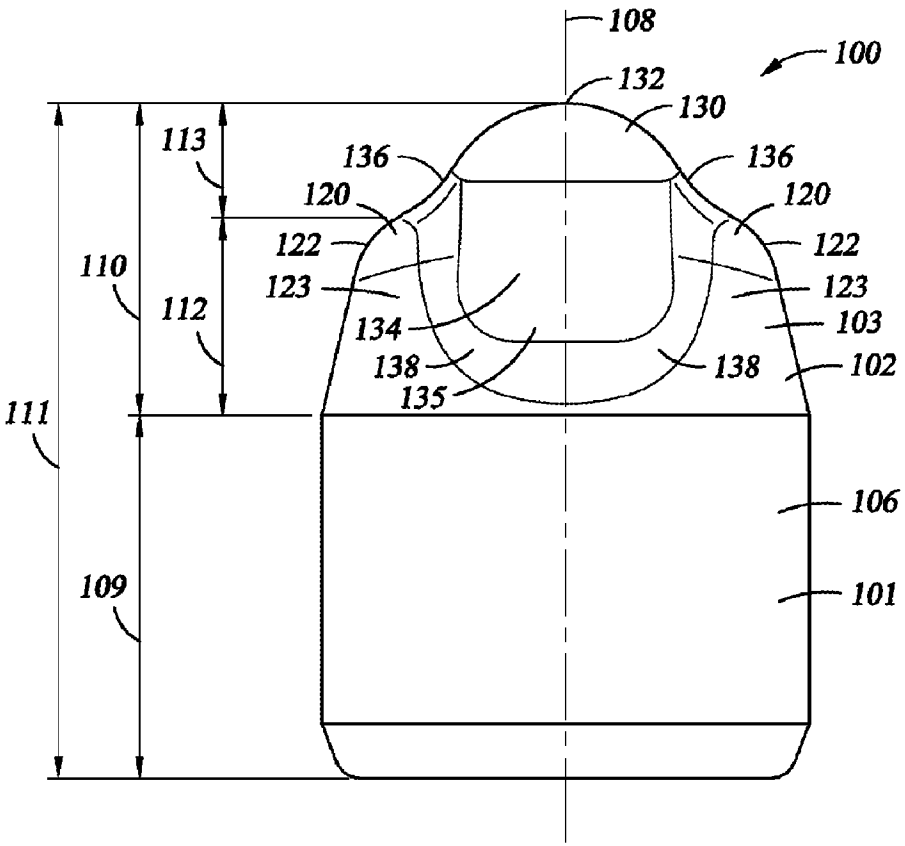
FIG. 4 is a front elevation view of the cutter element shown in FIG. 3.
Figure 5:
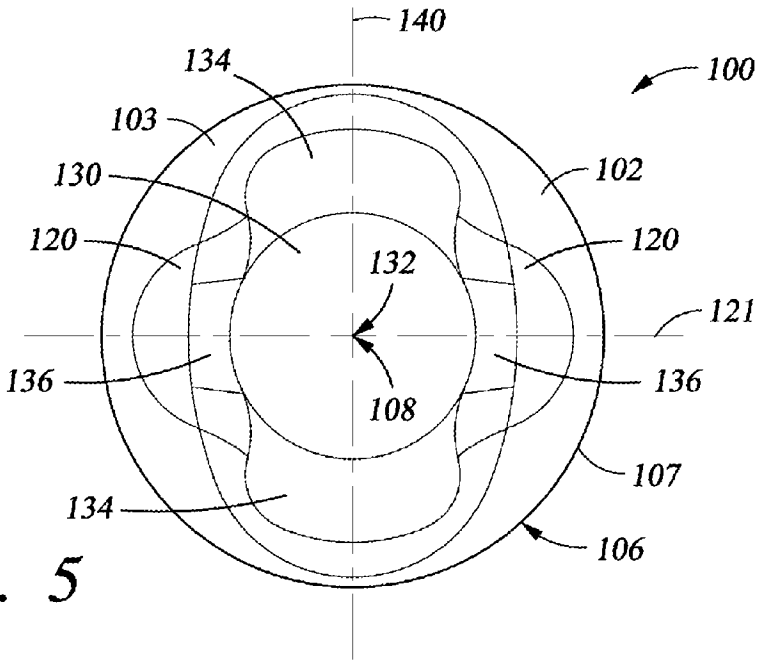
FIG. 5 is a top view of the cutter element shown in FIG. 3.

Referring now to FIGS. 3-6, cutter element insert 100 is shown to include a base portion 101 and a cutting portion 102 extending therefrom. Cutting portion 102 preferably includes a continuously contoured cutting surface 103 extending from the reference plane of intersection 104 that divides base 101 and cutting portion 102. In this embodiment, base portion 101 is generally cylindrical, having diameter 105, central axis 108, and an outer surface 106 defining an outer circular profile or footprint 107 of the insert (FIG. 5). As best shown in FIG. 4, base portion 101 has a height 109, and cutting portion 102 extends from the base so as to have an extension height 110. Collectively, base 101 and cutting portion 102 define the insert's overall height 111. Base portion 101 may be formed in a variety of shapes other than cylindrical. As conventional in the art, base portion 101 is preferably retained within a rolling cone cutter by interference fit, or by other means, such as brazing or welding, such that cutting portion 102 and cutting surface 103 extend beyond the cone steel. Once mounted, the extension height 110 of the cutter element 100 is the distance from the cone surface to the outermost point of the cutting surface 103 (relative to the cone axis) as measured parallel to the insert's axis 108.

Figure 3:
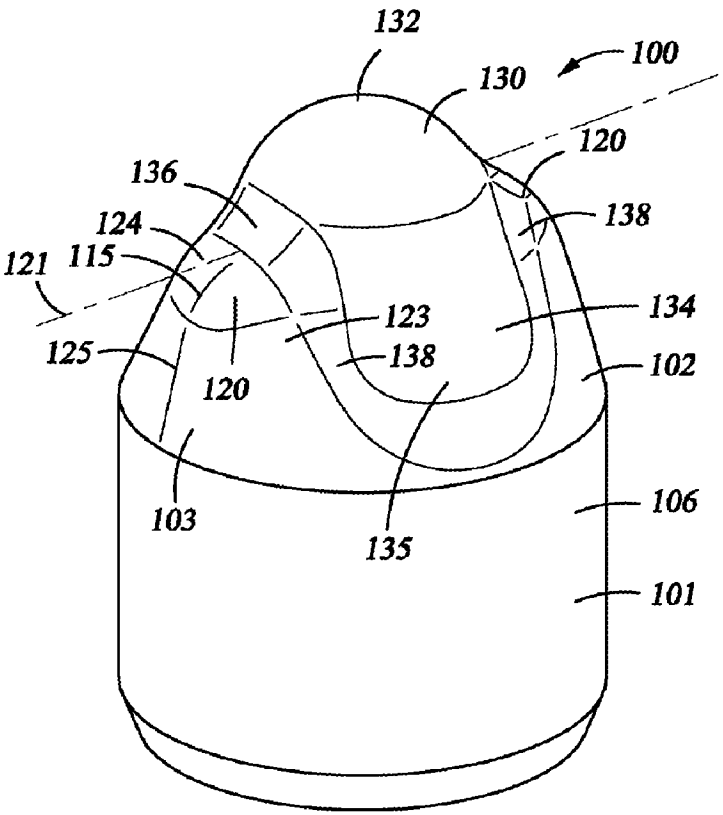
FIG. 3 is a perspective view of a cutter element having particular application in a rolling cone bit such as that shown in FIGS. 1 and 2.

In the embodiment shown, cutting portion 102 generally includes a chisel crest 115 and a pilot portion 130 intersecting chisel crest 115 and protruding beyond the height of crest 115 to extension height 110. Crest 115 includes a pair of flanking surfaces 123 that taper or incline towards one another and intersect in a peaked ridge 124, best shown in FIG. 6. Peaked ridge 124 extends generally linearly along a crest median line 121 (FIGS. 3, 7). As best shown in the profile view of FIG. 6, peaked ridge 124 is generally rounded at its apex. Chisel crest 115 extends between crest ends 122 having crest end surfaces 125. Crest end surfaces 125 are generally frustoconical as they extend from insert base 101 to crest end 122. In this embodiment, crest ends 122 are partial spheres defined by spherical radii, with the radius of each end 122 being identical. As described in examples below, in other cutter elements, the crest ends need not be spherical and may not be of uniform size.

Figure 6:
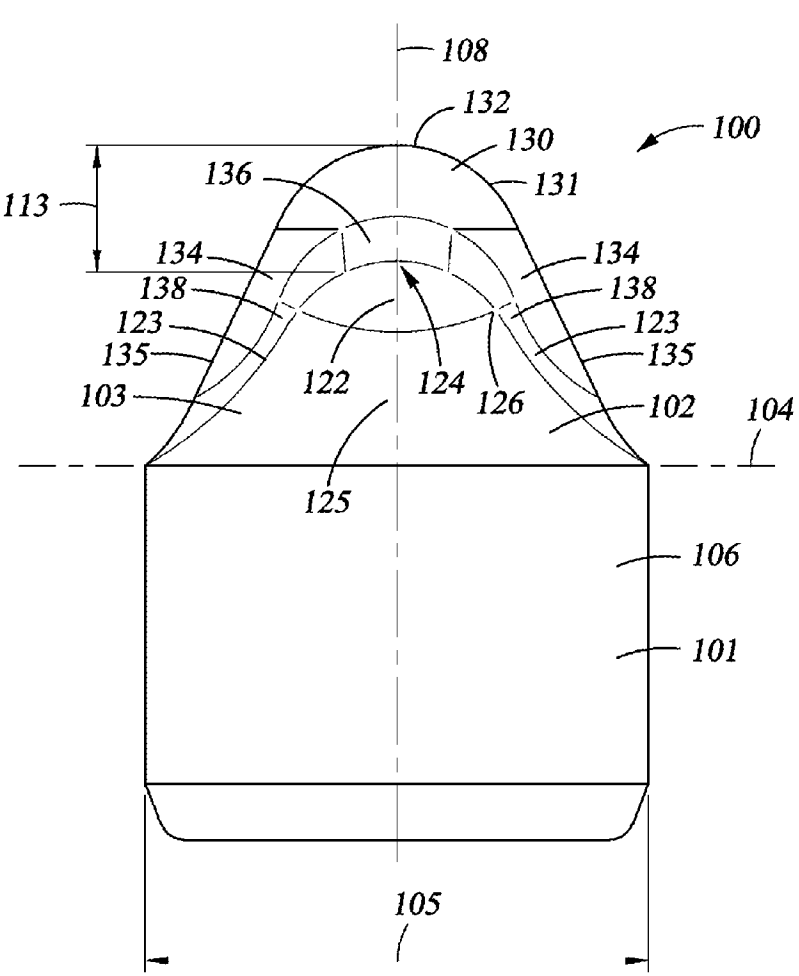
FIG. 6 is a side elevation view of the cutter element shown in FIG. 3.
Figure 7:
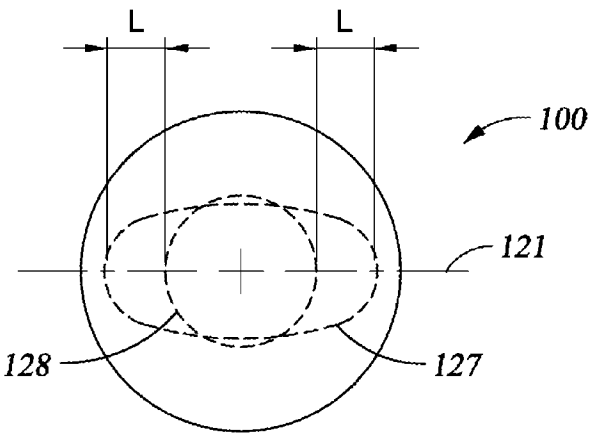
FIG. 7 is a schematic top view of the cutter element shown in FIGS. 3-6.

Referring still to FIGS. 3-6, in this embodiment, protruding pilot portion 130 generally bisects chisel crest 115, forming a pair of crest segments 120. As best shown in FIG. 6, crest 115 and crest segment 120 define what generally may be described as a crest end profile 126 which is represented by flanking surfaces 123. Each crest segment 120 extends to and defines a crest height 112, while protrusion or pilot portion 130 extends to the full insert height 111 and thus extends beyond crest height 112 by a distance defined herein as the step height 113. As shown in FIG. 6, the pilot end profile 131 of pilot portion 130 extends above crest end profile 126, and also extends laterally beyond crest end profile 126.

In this embodiment, pilot portion 130 comprises generally rounded apex 132 supported by a pair of buttress portions 134. Apex 132 is a partial sphere defined by a spherical radius. In this embodiment, the radius of apex 132 is larger than the spherical radius defining crest ends 122, and is preferably at least 20% greater than the spherical radius of ends 122. Likewise, in this embodiment, the radius of apex 132 is larger than the radius of curvature of the cross-section of chisel crest 115 taken perpendicular to crest 115 proximal crest ends 122. However, the size of apex 132 will vary depending upon numerous factors, including formation characteristics such as hardness, intended weight-on-bit, and other features associated with the particular bit and cutting structure design. Buttress portions 134 help to support rounded apex 132 and include buttress surfaces 135 that emerge from and extend laterally beyond the portion of crest end profile 126 that are formed by crest flanks 123. Buttress surfaces 135 thus represent and define a pilot end profile of pilot portion 130. In this embodiment, buttress portions 134 are generally bisected by a reference plane 140 (FIG. 5) which contains insert axis 108 and which extends generally perpendicularly to crest ridge 124 and crest median line 121.

As mentioned above, cutting surface 103 is preferably a continuously contoured surface. As used herein, the term "continuously contoured" means and relates to surfaces that can be described as having continuously curved surfaces that are free of relatively small radii (0.040 in. or smaller) as have conventionally been used to break sharp edges or round off transitions between adjacent distinct surfaces. Although certain reference or contour lines are shown in FIGS. 3-6 to represent general transitions between one surface and another, it should be understood that the lines preferably do not represent sharp transitions. Instead, all surfaces are preferably blended together to form the preferred continuously contoured surface and cutting profiles that are free from abrupt changes in radius. By eliminating small radii along cutting surface 103, detrimental stresses in the cutting surface are substantially reduced, leading to a more durable and longer lasting cutter element.

Cutting surface 103 includes transition surfaces between crest 115 and pilot portion 130 to reduce detrimental stresses. More particularly, cutting surface 103 includes a crest-to-apex transition surface 136 to blend the cutting surface between crest segments 120 and apex 132. Further, cutting surface 103 includes transition surfaces 138 generally transitioning between flanks 123 and outer surface 135 of buttress portions 134. Buttress surfaces 135 are generally frustoconical in the region extending between transition surfaces 138.

FIG. 7 represents a top view of insert 100 like that shown in FIG. 5; however, in FIG. 7, dashed lines 127 and 128 schematically represent what is referred to herein as the top profile of crest 115 and pilot portion 130, respectively. More particularly, line 127 represents the elongate and generally racetrack shape corresponding to the top profile of crest 115, line 127 generally shown at the intersection of flanks 123 and ridge 124. Likewise, line 128 represents the top profile of the generally conical pilot portion 130, top profile 128 generally shown in a plane perpendicular to insert axis 108 and at the location where pilot portion 130 intersects crest-to-apex transition 136. Comparing the top profiles 127, 128, as shown in FIG. 7, pilot portion 130 generally bisects crest 115 such that each crest segment 120 has substantially the same crest segment length L and such that the pilot portion 130 is equidistance from each crest end 122.

Figure 8:
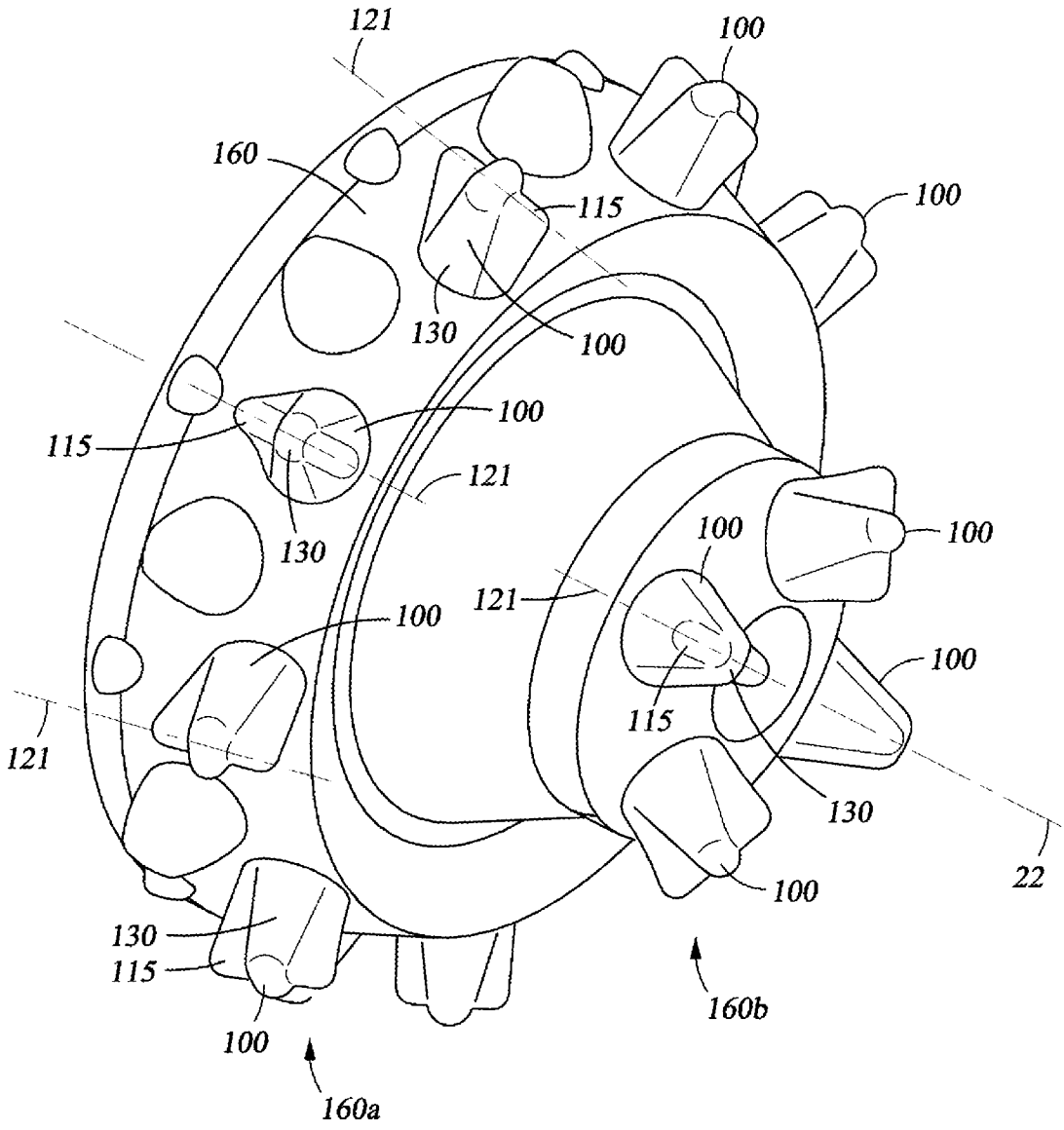
FIG. 8 is a perspective view of a portion of a rolling cone cutter having the cutter element of FIGS. 3-6 mounted therein.

Referring now to FIG. 8, insert 100 thus described is shown mounted in a rolling cone cutter 160 as may be employed, for example, in the bit 10 described above with reference to FIGS. 1 and 2, with cone cutter 160 substituted for any of the cones 1-3 previously described. As shown, cone cutter 160 includes a plurality of inserts 100 disposed in a circumferential inner row 160*a*. In this embodiment, inserts 100 are all oriented such that a projection of crest median line 121 is aligned with cone axis 22. Inserts 100 may be positioned in rows of cone cutter 160 in addition to or other than inner row 160*a*, such as in gage row 170*a*. Likewise, inserts 100 may be mounted in other orientations, such as in an orientation where a projection of the crest median line is skewed relative to the cone axis.

As understood by those in the art, the phenomenon by which formation material is removed by the impacts of cutter elements is extremely complex. The geometry and orientation of the cutter elements, the design of the rolling cone cutters, the type of formation being drilled, as well as other factors, all play a role in how the formation material is removed and the rate that the material is removed (i.e., ROP).

Depending upon their location in the rolling cone cutter, cutter elements have different cutting trajectories as the cone rotates in the borehole. Cutter elements in certain locations of the cone cutter have more than one cutting mode. In addition to a scraping or gouging motion, some cutter elements include a twisting motion as they enter into and then separate from the formation. As such, the cutter elements 100 may be oriented to optimize cutting that takes place as the cutter element both scrapes and twists against the formation. Furthermore, as mentioned above, the type of formation material dramatically impacts a given bit's ROP. In relatively brittle formations, a given impact by a particular cutter element may remove more rock material than it would in a less brittle or a plastic formation.

The impact of a cutter element with the borehole bottom will typically remove a first volume of formation material and, in addition, will tend to cause cracks to form in the formation immediately below the material that has been removed. These cracks, in turn, allow for the easier removal of the now-fractured material by the impact from other cutter elements on the bit that subsequently impact the formation. Without being held to this or any other particular theory, it is believed that an insert such as insert 100 having a pilot portion 130 extending above the crest 115, as described above, will enhance formation removal by propagating cracks further into the uncut formation than would be the case for a crested insert of similar design and size lacking the pilot portion 130. Further, providing an insert with crest segments 120 extending or radiating from pilot portion 130 also enhances formation removal by providing a substantial total crest length. In particular, it is anticipated that providing the pilot portion 130 with its relatively small cross-sectional area (from the top of crest 115 to its apex 132) will provide the cutter element with the ability to penetrate deeply without the requirement of adding substantial additional weight-on-bit to achieve that penetration. Pilot portion 130 leads the cutter element into the formation and initiates the insert's penetration. Once the pilot section 130 has penetrated the rock to the step height 113 of the insert, it is anticipated that substantial cracking of the formation will have occurred, allowing the crest segments 120 to gouge and scrape away a substantial volume of formation material as crest 115 sweeps across (and in some cone positions, twists through) the formation material. Further, by the pilot portion 130 extending deeper into the formation than would be the case with a similarly-sized chisel insert, but one without the pilot portion 130, it is believed that the insert 100 will create deeper cracks into a localized area, allowing the remainder of the cutter insert (e.g., crest segments 120) and the cutter elements that follow thereafter to remove formation material at a faster rate.

Figure 9:
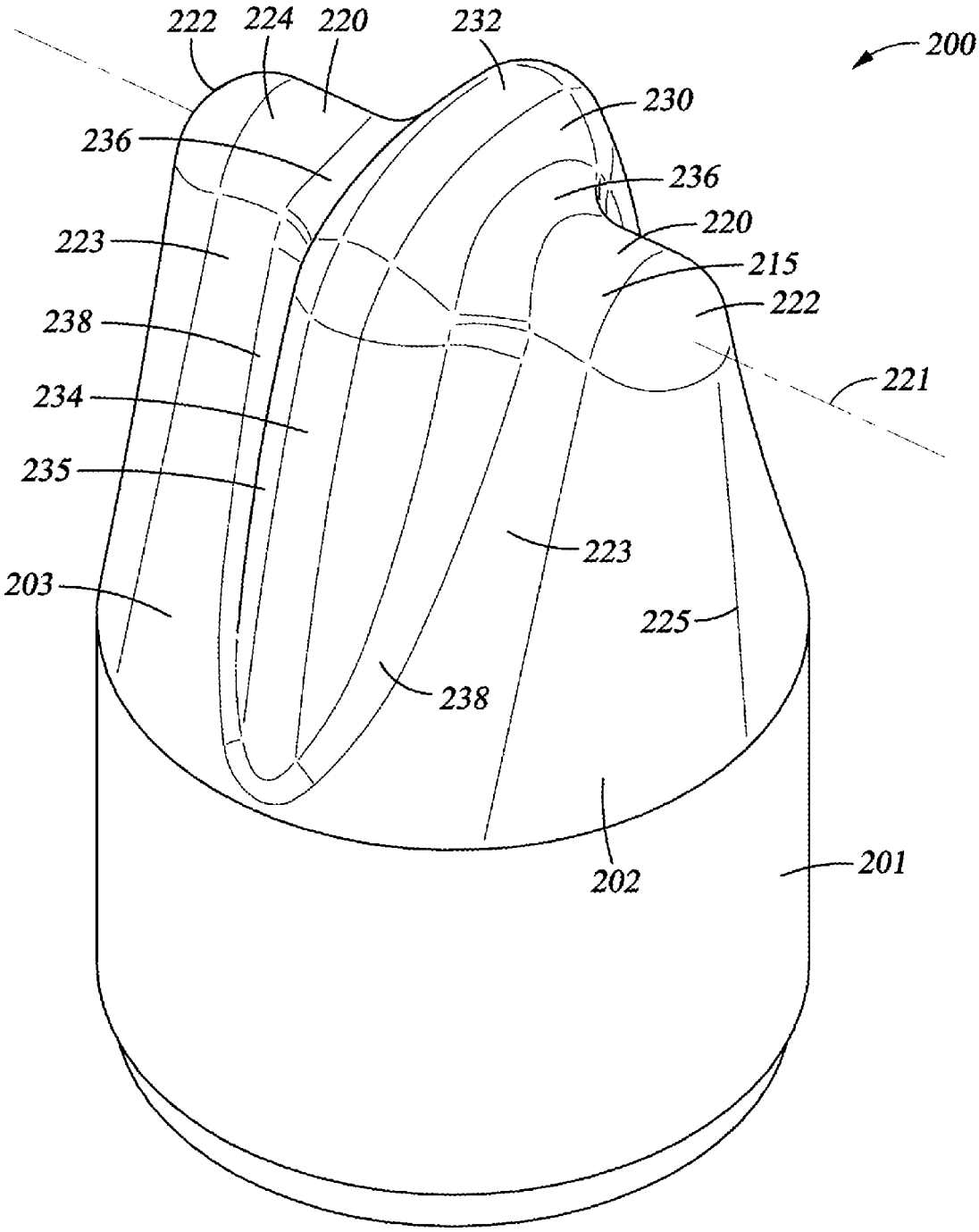
FIG. 9 is a perspective view of an alternative cutter element having particular application in a rolling cone bit, such as that shown in FIGS. 1 and 2.
Figure 10:
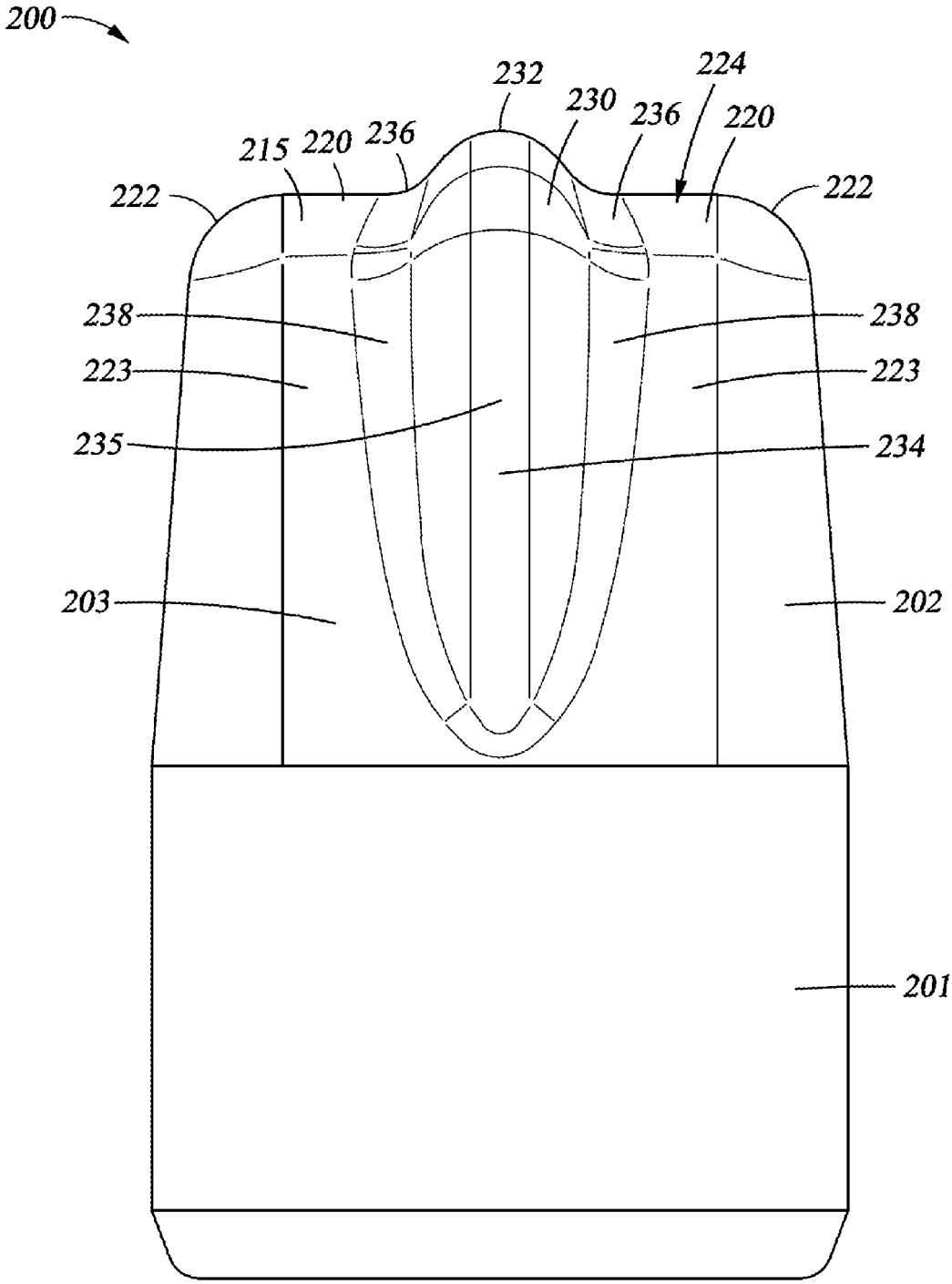
FIG. 10 is a front elevation view of the cutter element shown in FIG. 9.
Figure 11:
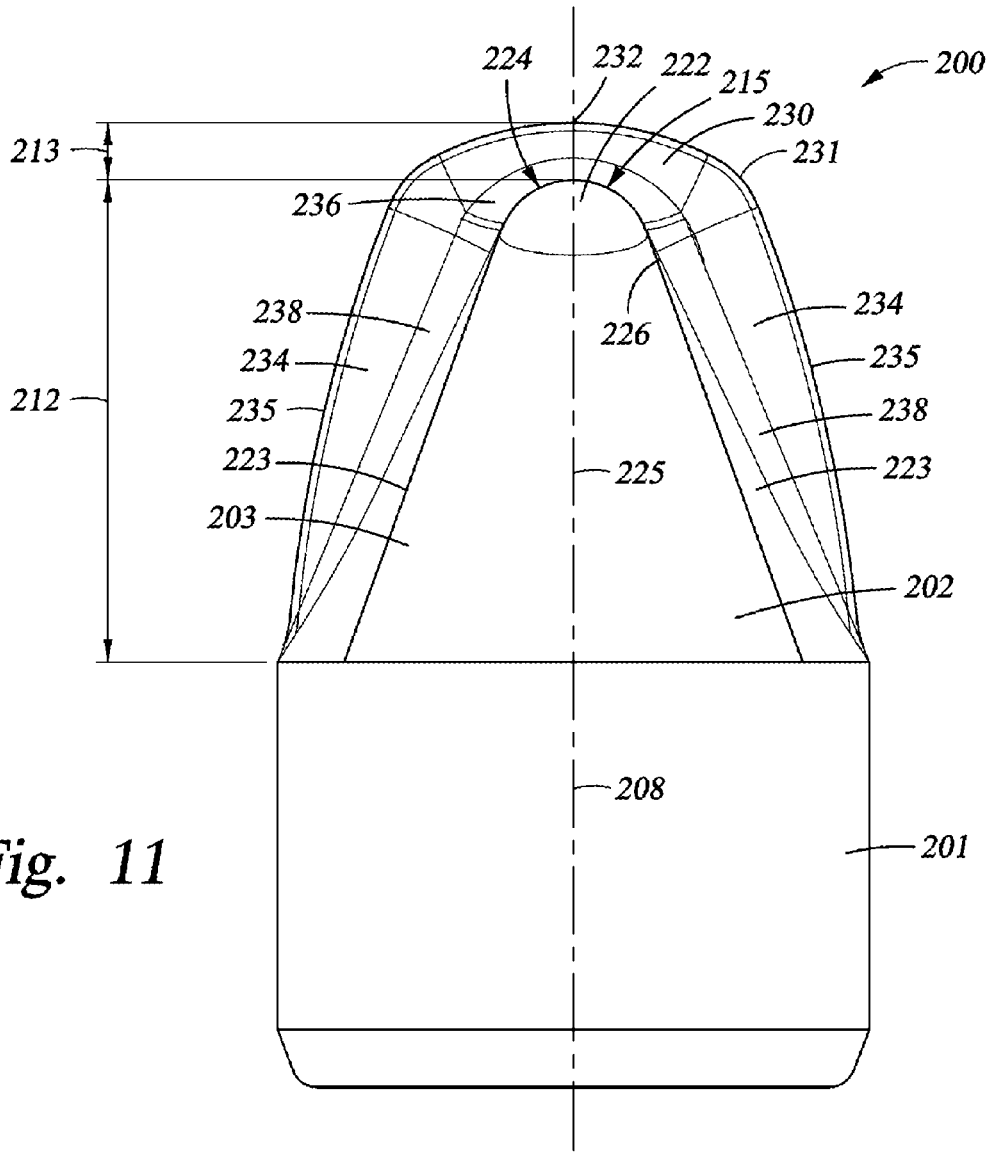
FIG. 11 is a side elevation view of the cutter element shown in FIG. 9.

Referring now to FIGS. 9-11, a cutter element 200 is shown to include a cutting portion 202 having a pilot portion 230 intersecting and extending above chisel crest 215 by a step height 213. In this embodiment, pilot portion 230 bisects crest 215 forming a pair of crest segments 220 of equal length. More specifically, insert 200 includes a base 201, substantially identical to base 101 previously described, and a cutting portion 202 extending from base 201 and having a cutting surface 203. Cutting surface 203 is preferably continuously contoured and is similar to cutting portion 102 of insert 100 previously described, the major difference being that in insert 200, cutting portion 202 includes a pilot portion 230 that includes an elongated chisel crest 232 rather than the rounded apex 132 of insert 100.

In still more detail, cutting portion 202 includes an elongate crest 215 that extends along crest median line 221 and terminates at crest ends 222. Crest ends 222 include end surfaces 225 which are generally frustoconical and extend from base 201 to crest end 222. Crest 215 includes a pair of flanking surfaces 223 which taper toward one another and intersect in peaked ridge 224, ridge 224 extending along crest median line 221. Flanking surfaces 223, along with peaked ridge 224, define a crest end profile 226 as best shown in FIG. 11. Crest ends 222 present partial spherical surfaces defined by spherical radii, where the radius of each end 222 is identical in this embodiment.

Pilot portion 230 extends above crest 215 and includes a pilot crest 232 that is supported by buttress portions 234. In this embodiment, crest 232 extends in a direction generally perpendicular to crest median line 221, and is slightly convex, crest 232 being highest at the point that it intersects insert axis 208 in this embodiment. Pilot crest 232 and the side surfaces 235 of buttress portions 234 define a pilot portion end profile 231.

The pilot end profile 231 extends above crest end profile 226 and also extends laterally beyond crest end profile 226. As shown in FIG. 11, the buttress portions 234 extend laterally well beyond flanks 223 and crest end profile 226.

Referring to FIG. 11, crest 215 extends to and defines a crest height 212. Likewise, pilot portion 230 extends to the full insert height and extends beyond crest height 212 by a distance defined herein as the "step height" 213 of insert 200 and of cutting portion 202.

Cutting surface 203 of insert 200 includes transition surfaces between crest 215 and pilot portion 230 so as to reduce detrimental stresses. Accordingly, cutting surface 203 includes a crest-to-crest transition surface 236 to blend the cutting surfaces between crest segments 220 and the pilot portion crest 232. Further, cutting surface 203 includes transition surfaces 238 that generally transition between the flanking surfaces 223 of crest 215 and the outer surface 235 of buttress portions 234.

Figure 12:
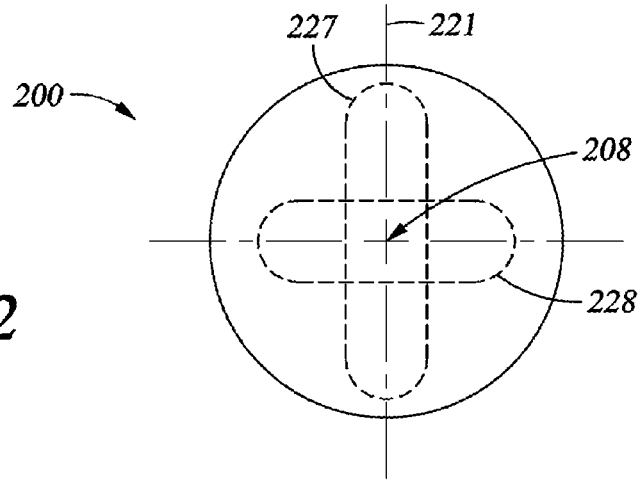
FIG. 12 is a schematic top view of the cutter element shown in FIGS. 9-11.

FIG. 12 represents top view of insert 200 similar to that of insert 100 shown in FIG. 7. Dashed line 227 schematically represents the top profile of chisel crest 215 and dashed line 228 schematically represents the top profile of pilot crest 232. As shown in this embodiment, crests 215 and 232 extend in directions that are generally perpendicular to each other in position such that the median line of each crest passes through the insert axis 208. In this embodiment, each crest is described as having zero offset from the insert axis. Further, in this embodiment, pilot crest 232 generally bisects crest 215. As described more fully below, in other embodiments, crests 215 and 232 may not be perpendicular, but may intersect to form acute angles therebetween. Further, pilot crest 232 may be positioned near to one end or the other of crest 215 such that crest 215 would be divided into two crest segments of unequal length. Likewise, one or both crests 215, 232 may be offset from the insert axis.

As best shown in the profile view of FIG. 10, crest 232 of pilot portion 230 includes a rounded apex having a relatively small radius and narrow width. So configured, crest 232 serves as a pilot portion for insert 200 by first contacting the formation material with its relatively sharp apex and its short crest length (relative to the length of chisel crest 215). In this configuration, pilot portion 230 may initially penetrate the formation with less weight-on-bit than would be otherwise required for a crested insert without pilot portion 230. Likewise, once insert 200 has penetrated the formation material to the step height 213, the pilot portion 230 may cause cracking or fracturing deeper into the formation than would a crested insert of similar size and shape but without pilot portion 230, thereby enabling this "pre-fractured" formation material to be removed more readily as crest 215 impacts that material, or as following cutter elements subsequently impact this portion of the formation.

Figure 13:
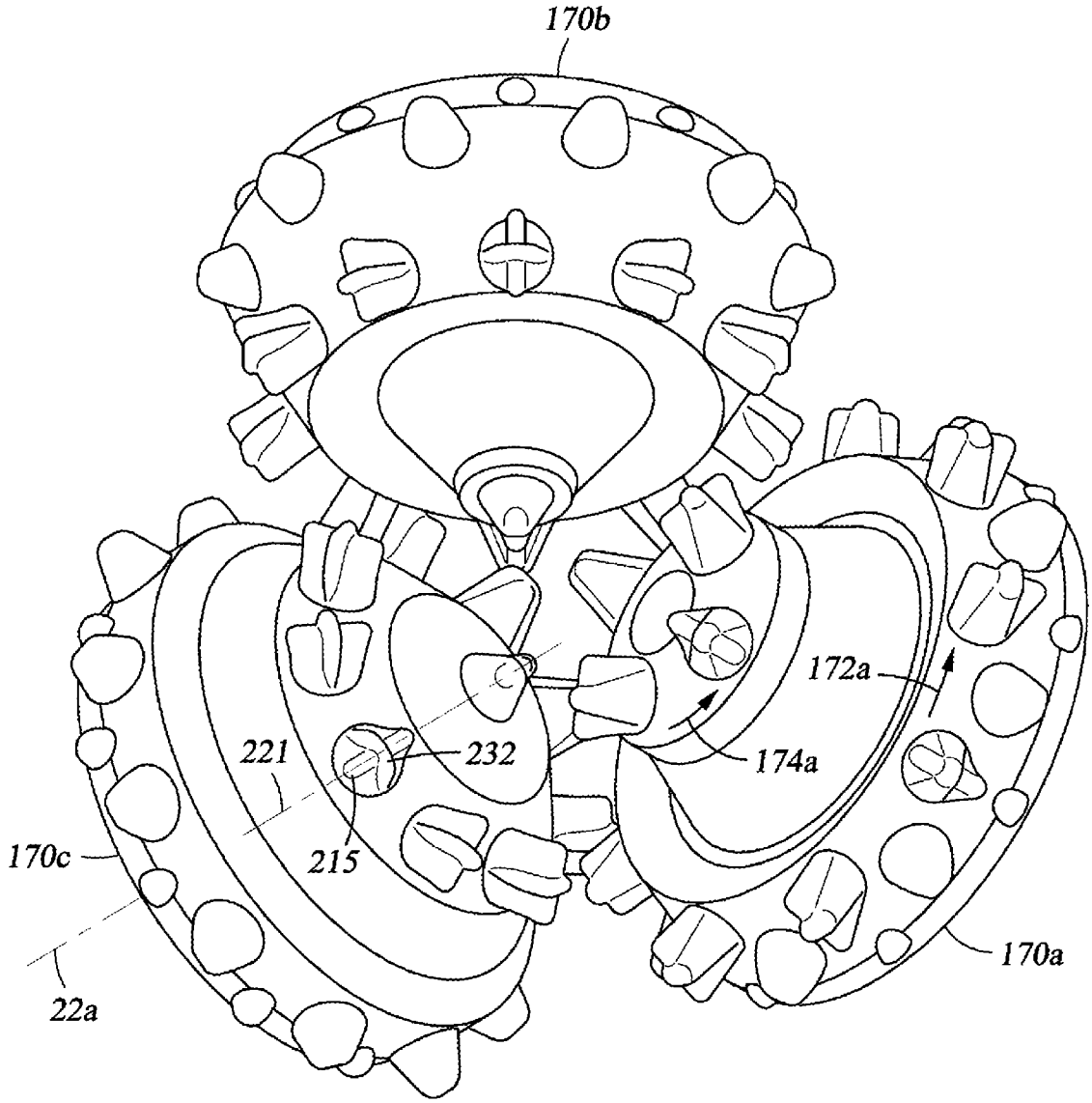
FIG. 13 is a perspective view of a three-cone drill bit having the cutter element of FIGS. 9-11 mounted therein.

FIG. 13 shows a drill bit having three rolling cones 170*a, b, c*, generally the same as cone cutters 1-3 described with reference to FIG. 1. Each cone cutter 170 includes at least one circumferential inner row employing cutter element 200 previously described. As an example, referring to cone 170*a*, it includes a first inner row 172*a* and a second inner row 174*a* disposed closer to bit axis 11 than row 172*a*. In this embodiment, each cutter insert 200 is oriented in cone 170*a* such that its chisel crest 215 is oriented to be generally aligned with cone axis 22*a*. More particularly, each crest 215 extends along a median line 221, a projection of which is aligned with cone axis 22*a*. Pilot crest 232, being substantially transverse to chisel crest 215 in this example, has a projection that is generally perpendicular to cone axis 22*a*. The inserts 200 in row 174*a* are similarly oriented, although, in other embodiments, the chisel crests 215 and 232 may be oriented differently from row to row, and may be oriented differently as among the inserts 200 in a particular row.

The materials used in forming the various portions of cutter elements 100, 200 may be particularly tailored to best perform and best withstand the type of cutting duty experienced by that portion of the cutter element. For example, it is known that as a rolling cone cutter rotates within the borehole, different portions of a given insert will lead as the insert engages the formation and thereby be subjected to greater impact loading than a lagging or following portion of the same insert. With many conventional inserts, the entire cutter element was made of a single material, a material that of necessity was chosen as a compromise between the desired wear resistance or hardness and the necessary toughness. Likewise, certain conventional gage cutter elements include a portion that performs mainly side wall cutting, where a hard, wear resistant material is desirable, and another portion that performs more bottom hole cutting, where the requirement for toughness predominates over wear resistance. With the inserts 100, 200 described herein, the materials used in the different regions of the cutting portion can be varied and optimized to best meet the cutting demands of that particular portion.

More particularly, because the pilot portions 130, 230 of inserts 100, 200 are intended to experience more force per unit area upon the insert's initial contact with the formation, and to penetrate deeper than chisel crests 115, 215 it is desirable, in certain applications, to form different portions of the inserts' cutting portion of materials having differing characteristics. In particular, in at least one embodiment, pilot portion 130 of insert 100 is made from a tougher, more facture-resistant material than is crest 115. In another embodiment, pilot crest 230 is made of a tougher, more fracture-resistant material than crest 215. In each of these examples, chisel crests 115, 215 are made of a harder, more wear-resistant material than pilot portion 130, 230, respectively.

Cemented tungsten carbide is a material formed of particular formulations of tungsten carbide and a cobalt binder (WC—Co) and has long been used as cutter elements due to the material's toughness and high wear resistance. Wear resistance can be determined by several ASTM standard test methods. It has been found that the ASTM B611 test correlates well with field performance in terms of relative insert wear life. It has further been found that the ASTM B771 test, which measures the fracture toughness (K1c) of cemented tungsten carbide material, correlates well with the insert breakage resistance in the field.

It is commonly known that the precise WC—Co composition can be varied to achieve a desired hardness and toughness. Usually, a carbide material with higher hardness indicates higher resistance to wear and also lower toughness or lower resistance to fracture. A carbide with higher fracture toughness normally has lower relative hardness and therefore lower resistance to wear. Therefore there is a trade-off in the material properties and grade selection.

It is understood that the wear resistance of a particular cemented tungsten carbide cobalt binder formulation is dependent upon the grain size of the tungsten carbide, as well as the percent, by weight, of cobalt that is mixed with the tungsten carbide. Although cobalt is the preferred binder metal, other binder metals, such as nickel and iron can be used advantageously. In general, for a particular weight percent of cobalt, the smaller the grain size of the tungsten carbide, the more wear resistant the material will be. Likewise, for a given grain size, the lower the weight percent of cobalt, the more wear resistant the material will be. However, another trait critical to the usefulness of a cutter element is its fracture toughness, or ability to withstand impact loading. In contrast to wear resistance, the fracture toughness of the material is increased with larger grain size tungsten carbide and greater percent weight of cobalt. Thus, fracture toughness and wear resistance tend to be inversely related. Grain size changes that increase the wear resistance of a given sample will decrease its fracture toughness, and vice versa.

As used herein to compare or claim physical characteristics (such as wear resistance, hardness or fracture-resistance) of different cutter element materials, the term "differs" or "different" means that the value or magnitude of the characteristic being compared varies by an amount that is greater than that resulting from accepted variances or tolerances normally associated with the manufacturing processes that are used to formulate the raw materials and to process and form those materials into a cutter element. Thus, materials selected so as to have the same nominal hardness or the same nominal wear resistance will not "differ," as that term has thus been defined, even though various samples of the material, if measured, would vary about the nominal value by a small amount.

There are today a number of commercially available cemented tungsten carbide grades that have differing, but in some cases overlapping, degrees of hardness, wear resistance, compressive strength and fracture toughness. Some of such grades are identified in U.S. Pat. No. 5,967,245, the entire disclosure of which is hereby incorporated by reference.

Inserts 100, 200 may be made in any conventional manner such as the process generally known as hot isostatic pressing (HIP). HIP techniques are well known manufacturing methods that employ high pressure and high temperature to consolidate metal, ceramic, or composite powder to fabricate components in desired shapes. Information regarding HIP techniques useful in forming inserts described herein may be found in the book Hot Isostatic Processing by H. V. Atkinson and B. A. Rickinson, published by IOP Publishing Ptd., ©1991 (ISBN 0-7503-0073-6), the entire disclosure of which is hereby incorporated by this reference. In addition to HIP processes, the inserts and clusters described herein can be made using other conventional manufacturing processes, such as hot pressing, rapid omnidirectional compaction, vacuum sintering, or sinter-HIP.

Inserts 100, 200 may also include coatings comprising differing grades of super abrasives. Super abrasives are significantly harder than cemented tungsten carbide. As used herein, the term "super abrasive" means a material having a hardness of at least 2,700 Knoop (kg/mm$^2$). PCD grades have a hardness range of about 5,000-8,000 Knoop (kg/mm$^2$) while PCBN grades have hardnesses which fall within the range of about 2,700-3,500 Knoop (kg/mm$^2$). By way of comparison, conventional cemented tungsten carbide grades typically have a hardness of less than 1,500 Knoop (kg/mm$^2$). Such super abrasives may be applied to the cutting surfaces of all or some portions of the inserts. In many instances, improvements in wear resistance, bit life and durability may be achieved where only certain cutting portions of inserts 100, 200 include the super abrasive coating.

Certain methods of manufacturing cutter elements with PDC or PCBN coatings are well known. Examples of these methods are described, for example, in U.S. Pat. Nos. 5,766,394, 4,604,106, 4,629,373, 4,694,918 and 4,811,801, the disclosures of which are all incorporated herein by this reference.

As one specific example of employing superabrasives to inserts 100, 200, reference is again made to FIGS. 3, 8. As shown therein, pilot portion 130 may be made of a relatively tough tungsten carbide, and be free of a superabrasive coating, such as diamond, given that it must withstand more impact loading than chisel crest 115. It is known that diamond coatings are susceptible to chipping and spalling of the diamond coating when subjected to repeated impact forces. However, crest segments 120 may be made of a first grade of tungsten carbide and coated with a diamond or other superabrasive coating to provide the desired wear resistance.

As another example, and referring to FIG. 9, the protruding pilot chisel crest 232 on inserts 200, in this example, may be free of superabrasives so as to provide resistance to impact damage. In these inserts, however, crest segments 220 may be provided with a diamond or other superabrasive material to provide enhanced wear-resistance. As a still further example, reference is made to FIG. 13 in which inserts 200*a* include a diamond or other superabrasive material on chisel crest segment 220*a*, but where the opposing chisel crest segment 200*b* is free of superabrasive. In this example, it may be desirable to include the superabrasive material on crest segment 220*a*, as it is closer to the borehole and, due to its cutting trajectory, undergoes more scraping and receives less impact loading than the opposite crest segment 220*b*.

Thus, according to these examples, employing multiple materials and/or selective use of superabrasives, the bit designer, and ultimately the driller, is provided with the opportunity to increase ROP, and bit durability.

Figure 14:
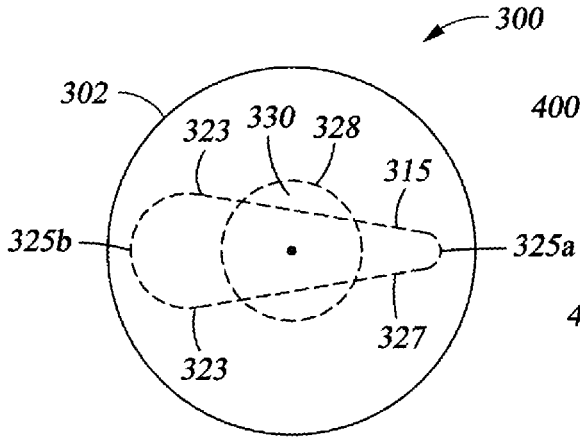
FIGS. 14-17 are schematic top views of alternative cutter elements having application in a rolling cone bit, such as that shown in FIGS. 1 and 2.

FIGS. 14-17 are similar to the views of FIGS. 7 and 12 and show, in schematic fashion, alternative cutter elements made in accordance with the principles previously disclosed. In particular, FIG. 14 shows that a cutter element 300 having a cutting portion 302 including a chisel crest 315 having a top profile 327 and pilot portion 330 having top profile 328. Similar to cutter element 100, cutter element 300 includes a generally spherical pilot portion 330; however, in this embodiment, crest 315 includes diverging flanks 323 which extend from a narrow crest end 325*a* to a wider crest end 325*b*. Crest flanks 323 taper towards one another as they extend from the base towards the top of the crest, and also diverge from one another as they extend from narrow crest end 325*a* to larger crest end 325*b*. In this example, each crest end 325 is generally spherical with a radius at end 325*b* larger than the radius of end 325*a*. In certain formations, and in certain positions in a rolling cone cutter, it is desirable to have a crest end with a greater mass of insert material. For example, insert 300 may be employed in a gage row, such as row 80*a* shown in FIGS. 1 and 2, with insert 300 positioned such that end 325*b* is closest to the borehole sidewall than crest end 325*a*.

Figure 15:
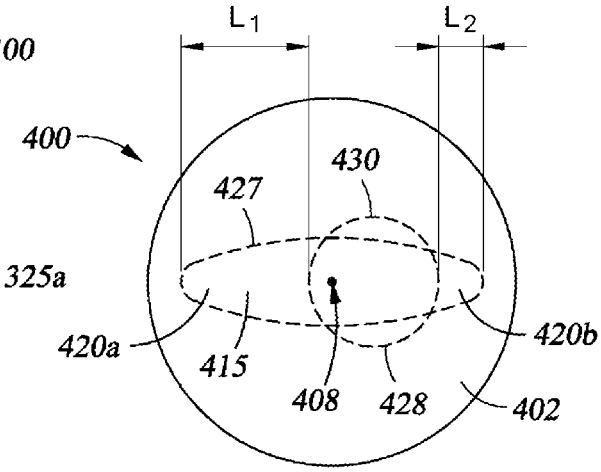

Disclosed in FIG. 15 is a cutter element 400 having cutting portion 402, chisel crest 415 and pilot portion 430. In this example, crest 415 is formed such that the insert axis 408 passes through the center of top crest profile 427. For use herein, such arrangement may be described as one in which the crest 415 has zero offset from the insert axis. By contrast, in this example, pilot portion 430 is offset relative to insert axis 408 such that insert axis 408 does not pass through the center of pilot top profile 428.

Also shown in FIG. 15, pilot portion 430 intersects crest 415 at a point other than the midpoint of crest 415. Given this arrangement, crest segments 420 have differing lengths, segment 420*a* having length $L_1$ which is larger than length $L_2$ of crest segment 420*b*.

Figure 16:
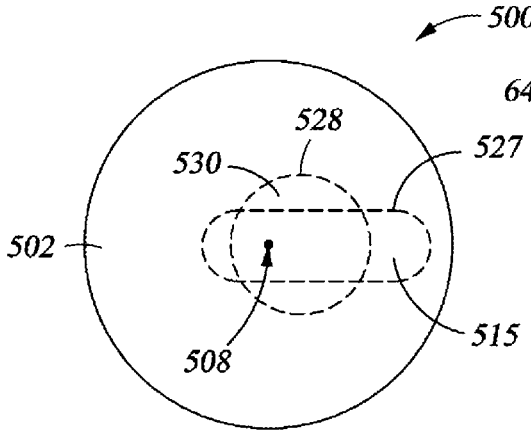

Referring now to FIG. 16, a cutter element 500 is shown in which cutting portion 502 includes an offset chisel crest 515 having top profile 527, and also including an offset pilot portion 530 represented by top pilot profile 528. In this example, chisel crest 515 and pilot portion 530 are offset relative to insert axis 508 in two orthogonal directions.

Figure 17:
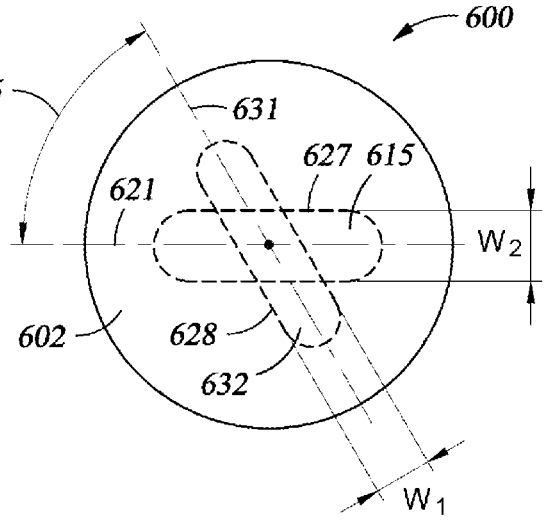

In FIG. 17, a cutter element 600 is shown including cutting portion 602 which includes a chisel crest 615 having top profile 627 and a pilot crest 632 having a top pilot profile 628. As shown, crest 615 extends generally along its crest median line 621 while pilot crest 632 extends along median line 631 which intersects median line 621 in an acute angle 645. In this example, too, pilot crest 632 has a crest width $W_1$ that is less than the crest width of chisel crest 615 as represented by $W_2$. In this embodiment, the narrower width of pilot crest 632 enhances penetration of the pilot portion without having to add additional weight-on-bit.

Figure 18:
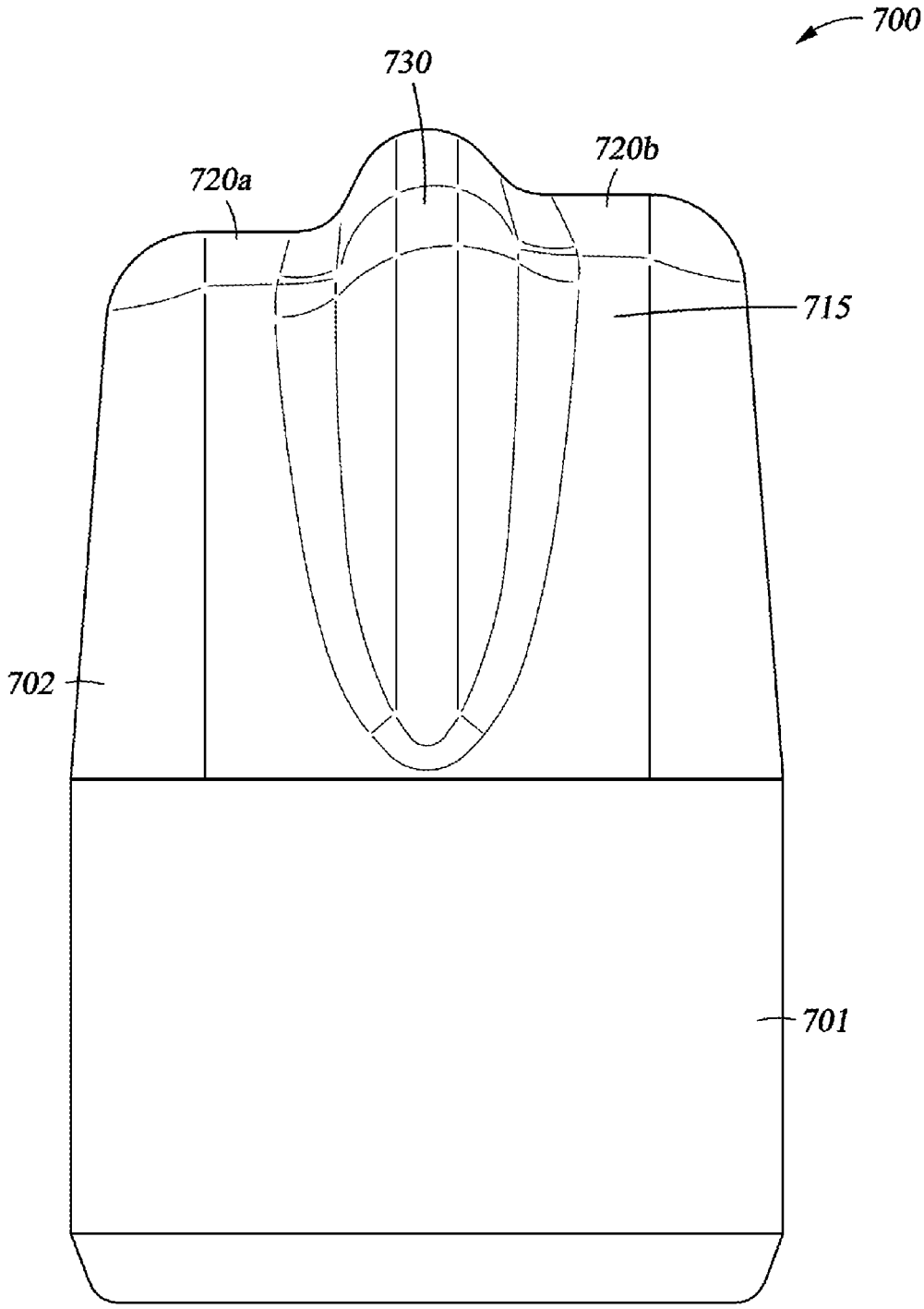
FIG. 18 is a front elevation view of another alternative cutter element for use in the bit of FIGS. 1 and 2.

Referring now to FIG. 18, cutter element 700 is shown having a pilot crest 730 which intersects chisel crest 715 and dividing crest 715 into two crest segments 720*a* and 720*b*. As shown, the crest segment height of 720*b* is greater than the crest height of crest segment 720*a*. Depending upon its location and orientation in a rolling cone cutter, it may be desirable to employ an insert 700 having one crest segment with a greater crest height than another.

Figure 19:
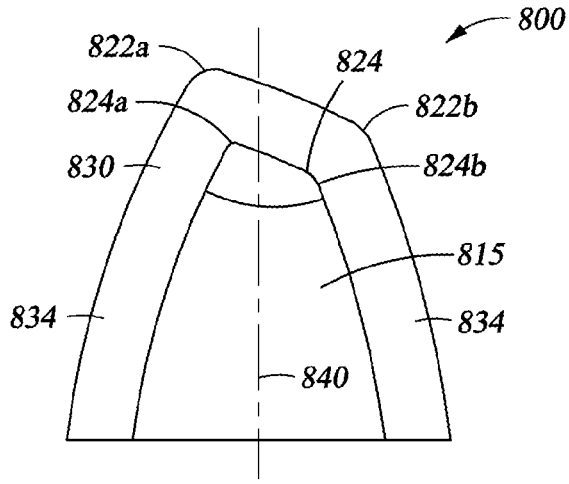
FIG. 19 is a side elevation view of another alternative cutter element.
Figure 20:
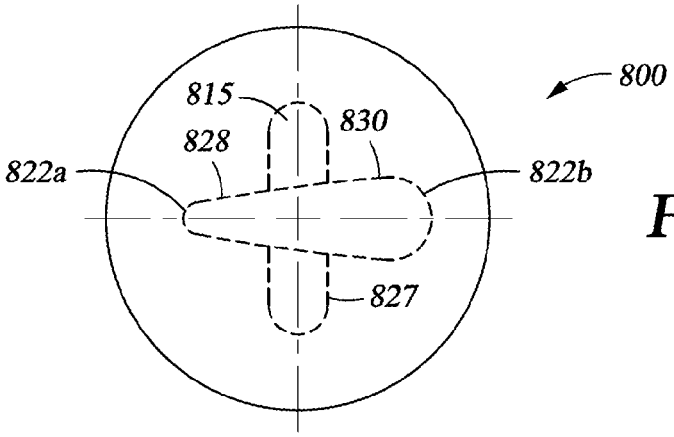
FIG. 20 is a schematic top view of the cutter element shown in FIG. 19.

FIGS. 19 and 20 show another alternative cutter element 800 having chisel crest 815 and pilot chisel crest 830. Pilot chisel crest 830 is more narrow at one end than the other and defines a top pilot profile 828 tapering from narrow crest end 822*a* to broad crest end 822*b* as best shown in FIG. 20. In the embodiment shown in FIG. 19, the crest of pilot portion 830 is highest adjacent to crest end 822*a* and tapers linearly to a lower position at crest end 822*b*. In different embodiments, pilot crest 830 tapers non-linearly between crest ends 822*a*, 822*b*. As such, pilot crest 830 may be characterized as having a sharper end 822*a* and tapering to a broader, less-sharp lower end 822*b*. In this embodiment, end profile of chisel crest 815 is asymmetrical in that peak ridge 824 includes a peak that is offset from a reference plane 840 bisecting crest 815 such that the peaked ridge 824, in end profile, slopes similarly to pilot portion 830 from a highest point 824*a* to a lowest point 824*b*.

Figure 21:
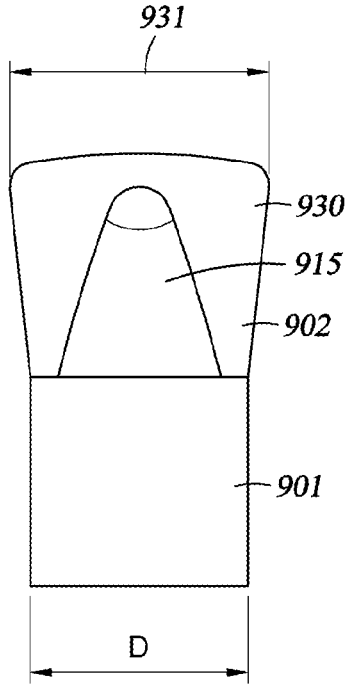
FIG. 21 is a side elevation view of another alternative cutter element.

Insert 900 is shown in FIG. 21 and includes a cutting portion 902 having a chisel crest 915 similar to chisel crest 115 described with reference to insert 100. Further, insert 900 includes a pilot portion 930 extending beyond chisel crest 915. In this embodiment, pilot crest 930 includes a generally flat crest and a side profile that tapers outwardly from base 901 to the uppermost extension of pilot portion 930. In other words, the length 931 of pilot crest 930 exceeds the diameter D of base 901. An insert 900 having a relatively wide or expansive pilot crest 930 may have particular application in relatively soft formations.

While preferred embodiments have been shown and described, modifications thereof can be made by one skilled in the art without departing from the spirit or teaching herein. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A cutter element for a drill bit comprising:

a base portion comprising a periphery;

a cutting portion extending from the base portion and comprising a cutting surface;

wherein the cutting surface includes a first elongate chisel crest having end portions and flanking surfaces meeting in an elongate and a peaked ridge defining a crest height, and a pilot portion intersecting the chisel crest between said end portions and extending above the crest height, wherein each of the flanking surfaces extends to the periphery, wherein the pilot portion comprises a second elongate chisel crest extending across said first elongate chisel crest.

2. The cutter element of claim 1, wherein the pilot portion includes a buttress portion emerging from at least one of the flanking surfaces of the chisel crest.

3. The cutter element of claim 1, wherein the first chisel crest comprises a first material having a first hardness and the second chisel crest comprises a second material having a second hardness, and wherein the first hardness is greater than the second hardness.

4. The cutter element of claim 1, wherein the second chisel crest bisects the first chisel crest in top view.

5. The cutter element of claim 1, wherein the first chisel crest extends along a first crest median line from a first crest end to a second crest end;

wherein the second chisel crest extends along a second crest median line from a first crest end to a second crest end;

wherein the second crest median line is perpendicular to the first crest median line in top view.

6. The cutter element of claim 5, wherein the base portion has a central axis, and wherein the first crest median line and the second crest median line each intersect the central axis in top view.

7. The cutter element of claim 1, wherein the base portion has a central axis; wherein the first chisel crest extends along a first crest median line from a first crest end to a second crest end;

wherein the second chisel crest extends along a second crest median line from a first crest end to a second crest end;

wherein the second crest median line is oriented at an acute angle relative to the first crest median line in top view.

8. The cutter element of claim 1, wherein the base portion has a central axis; wherein the first chisel crest extends along a first crest median line from a first crest end to a second crest end;

wherein the second chisel crest extends along a second crest median line from a first crest end to a second crest end;

wherein at least one of the first crest median line and second crest median line is offset from the central axis in top view.

9. The cutter element of claim 1, wherein the second chisel crest includes a first end and a second end, and wherein the first end is wider than the second end.

10. The cutter element of claim 9, wherein the second end of the second chisel crest extends further from the base than the first end of the second chisel crest.

11. The cutter element of claim 1, wherein the first chisel crest has a first crest end and a second crest end;

wherein the first chisel crest includes a first crest segment extending from the first crest end of the first chisel crest to the second chisel crest, and a second crest segment extending from the second crest end of the first chisel crest to the second chisel crest;

wherein the first crest segment and the second crest segment extend to a crest height relative to the base portion; and wherein the second chisel crest extends beyond the crest height by a step height, the step height being at least 10% of the crest height.

12. The cutter element of claim 1, wherein the second chisel crest slopes from a first crest end to a second crest end.

13. The cutter element of claim 1, wherein the base periphery comprises a cylindrical surface having a diameter and a central longitudinal axis, wherein said first elongate crest comprises a length as measured along a line perpendicular to said central longitudinal axis from one end portion to the other end portion, wherein said length is not greater than said diameter.

14. The cutter element of claim 13 wherein the second elongate chisel crest comprises a length as measured along a line perpendicular to said central longitudinal axis, wherein said length of said second elongate chisel crest is not greater than said diameter.

15. The cutter element of claim 1, wherein each end portion comprises a rounded surface.

16. The cutter element of claim 1, wherein each end portion comprises a partial spherical surface.

17. A drill bit for cutting a borehole having a borehole sidewall, corner and bottom, the drill bit comprising:

a bit body including a bit axis;

a rolling cone cutter mounted on the bit body and adapted for rotation about a cone axis;

a cutter element having a base portion having a periphery secured in the rolling cone cutter and a cutting portion extending therefrom;

wherein the cutting portion comprising a first chisel crest having end portions and flanking surfaces tapering to form an elongate and peaked ridge defining a first crest height, and a pilot portion intersecting the first chisel crest between said end portions and extending beyond the first crest height, wherein each of the flanking surfaces extends to the periphery, wherein the pilot portion comprises a second chisel crest extending across said first chisel crest.

18. The drill bit of claim 17, wherein at least one of the first and second chisel crests slopes from a first end toward a second end.

19. The drill bit of claim 17, wherein the first chisel crest extends generally linearly along a first crest median line, and wherein the cutter element is oriented in the rolling cone cutter such that a projection of the first crest median line is generally aligned with the cone axis.

20. The drill bit of claim 19, wherein the second chisel crest extends in a direction generally perpendicular to the first median line of the first chisel crest.

21. The drill bit of claim 17, wherein the first chisel crest has a first chisel crest length and the second chisel crest has a second chisel crest length that is less than the first chisel crest length.

22. The drill bit of claim 17, wherein the first chisel crest includes a pair of crest ends, one of the crest ends being sharper than the other, and wherein the cutter element is positioned in the cone cutter such that the sharper chisel crest end is closer to the bit axis than to the borehole sidewall.

23. The drill bit of claim 17 wherein the second chisel crest has a first end and a second end, wherein the first end extends farther from the cone cutter than the second end.

24. The drill bit of claim 23, wherein the cutter element is oriented in the cone cutter such that the first end of the second chisel crest is closer to the borehole bottom than the second end of the second chisel crest when the cutter element is in a position farthest from the drill bit axis and closest to the borehole sidewall.

25. The drill bit of claim 17, wherein the base periphery comprises a cylindrical surface having a diameter and a central longitudinal axis, wherein said first elongate crest comprises a length as measured along a line perpendicular to said central longitudinal axis from one end portion to the other end portion, wherein said length is not greater than said diameter.

26. The drill bit of claim 25, wherein the second elongate chisel crest comprises a length as measured along a line perpendicular to said central longitudinal axis, wherein said length of said second elongate chisel crest is not greater than said diameter.

27. The drill bit of claim 17, wherein each end portion comprises a rounded surface.

28. The drill bit of claim 17, wherein each end portion comprises a partial spherical surface.

* * * * *